US006955231B1

(12) United States Patent
Bakke

(10) Patent No.: US 6,955,231 B1
(45) Date of Patent: Oct. 18, 2005

(54) TOOL FOR CHANGING THE DRILLING DIRECTION WHILE DRILLING

(75) Inventor: Stig Bakke, Ålgård (NO)

(73) Assignee: Bakke Technology, AS, Algard (NO)

( * ) Notice: Subject to any disclaimer, the term of this patent is extended or adjusted under 35 U.S.C. 154(b) by 50 days.

(21) Appl. No.: 10/030,413

(22) PCT Filed: Jun. 21, 2000

(86) PCT No.: PCT/NO00/00213

§ 371 (c)(1),
(2), (4) Date: May 7, 2002

(87) PCT Pub. No.: WO01/00960

PCT Pub. Date: Jan. 4, 2001

(30) Foreign Application Priority Data

Jun. 24, 1999 (NO) ..... 993138

(51) Int. Cl.[7] ..... E21B 7/04; E21B 15/04
(52) U.S. Cl. ..... 175/61; 175/73; 175/92
(58) Field of Search ..... 175/57, 61, 62, 175/73, 76, 92, 320, 325.1

(56) References Cited

U.S. PATENT DOCUMENTS

| | | | | |
|---|---|---|---|---|
| 5,316,094 A | | 5/1994 | Pringle | |
| 5,392,867 A | | 2/1995 | Du Chaffaut et al. | |
| 5,441,119 A | * | 8/1995 | Head | 175/74 |
| 5,450,914 A | * | 9/1995 | Coram | 175/73 |
| 5,483,987 A | * | 1/1996 | Amaudric du Chaffaut et al. | 137/2 |
| 5,503,235 A | * | 4/1996 | Falgout, Sr. | 175/61 |
| 5,535,835 A | * | 7/1996 | Walker | 175/73 |
| 5,669,457 A | * | 9/1997 | Sebastian et al. | 175/73 |
| 5,775,444 A | * | 7/1998 | Falgout, Sr. | 175/322 |
| 5,836,406 A | * | 11/1998 | Schuh | 175/61 |
| 5,894,896 A | | 4/1999 | Smith et al. | |
| 5,931,239 A | * | 8/1999 | Schuh | 175/61 |
| 6,059,050 A | * | 5/2000 | Gray | 175/73 |
| 6,158,529 A | * | 12/2000 | Dorel | 175/61 |
| 6,244,361 B1 | * | 6/2001 | Comeau et al. | 175/61 |
| 6,419,014 B1 | * | 7/2002 | Meek et al. | 166/255.2 |
| 6,439,321 B1 | * | 8/2002 | Gillis et al. | 175/73 |
| 6,554,083 B1 | * | 4/2003 | Kerstetter | 175/61 |
| 6,561,289 B2 | * | 5/2003 | Portman et al. | 175/104 |
| 6,571,888 B2 | * | 6/2003 | Comeau et al. | 175/61 |
| 2001/0022241 A1 | * | 9/2001 | Portman et al. | 175/61 |

FOREIGN PATENT DOCUMENTS

GB 2271795 4/1994

* cited by examiner

*Primary Examiner*—David Bagnell
*Assistant Examiner*—Jennifer Gay
(74) *Attorney, Agent, or Firm*—Moser, Patterson & Sheridan, L.L.P.

(57) ABSTRACT

A tool adapted for changing the direction of drilling during drilling. The drilling equipment used in the drilling includes a drill string, a bent sub, a drill motor, and a drill bit. The tool is positioned between the drill string and the bent sub, includes housing elements connected to one another, and has a passage for drilling fluid. The tool can be activated for rotation of the bent sub, so that the direction of drilling is changed in an infinitely variable manner. The tool includes a valve adapted for choking the passage so that the tool can be activated for rotation, a piston adapted for forced guiding of the rotation. The guides can be formed by twisted splines formed in the wall of the passage and in the wall of the opposite piston.

26 Claims, 6 Drawing Sheets

TOOL FOR CHANGING THE DRILLING DIRECTION WHILE DRILLING

RELATED APPLICATIONS

This application claims priority to and is a national stage of international application PCT/NO00/00213, filed Jun. 21, 2000, which claims priority to Norwegian application 19993138, filed Jun. 24, 1999.

BACKGROUND OF THE INVENTION

1. Field of the Invention

The invention relates to a tool, adapted for changing the drilling direction while drilling with drilling equipment, which preferably comprises a drill string, such as coiled tubing, a bent sub, drilling motor and drill bit.

2. Description of the Related Art

During directional drilling of a formation in the ground, e.g. in horizontal drilling of a well, it is common to use drilling equipment, which comprises a drill string, bent sub and drill bit. The drill string may be formed of coiled tubing, and the drill bit may be hydraulically driven by the fluid circulating in the drill string. The drilling direction is changed through rotation of the bent sub, and the rotation is effected by a tool which is positioned between the lower end of the drill string and the bent sub. In known tools the rotation cannot be infinitely variable, but has to be done in invariable angular turns in the range of 15–20 degrees. This means that the drilling direction cannot be changed with the desirable accuracy. Another drawback of known tools is that the admission of the drill bit will have to be reduced to allow rotation of the bent sub. The consequence of this may be that the drill bit loses its grip in the ground formation, so that instead of completing its rotation, the bent sub will return to its initial position. This is a condition which complicates and moreover delays the work of changing the drilling direction.

SUMMARY OF THE INVENTION

The main object of the present invention is to provide a tool, whereby the rotation of the bent sub may be carried out in an infinitely variable manner. Other objects are that the rotation should take place during full admission of the drill bit, and the rotation should take place at a speed which allows the measuring equipment to provide measurement results which are in accordance with the actual rotation. Thereby the drilling direction could be changed without the drawbacks mentioned above. Moreover, the tool will be somewhat easier to operate and provide greater precision during rotation than what has been normal. This has been realized through the present device by a tool adapted for changing the drilling direction during drilling. The drilling equipment used in the drilling, preferably comprises a drill string, such as coiled tubing, a bent sub, drill motor and drill bit. Further the tool is positioned between the drill string and the bent sub, comprises housing elements connected to one another, has a passage for, among other things, fluid such as drilling fluid, and may be activated for rotation of the bent sub, so that the direction of drilling is changed. The particular about the invention is that the tool is provided with means, which is adapted so that the rotation can be infinitely variable. Said means is provided in the through passage of the tool, and comprises a valve arranged to choke the passage, so that the tool can be activated for the rotation, a piston adapted for providing the rotation after the through passage has been choked, and sets of co-operating guides adapted for forced guiding of the rotation. The guides are formed in the wall of the through passage, or in the opposite wall of the piston. Other details of the invention will appear from the dependent claims and the following part of the specification.

BRIEF DESCRIPTION OF THE DRAWINGS

Referring to the appended set of figures, a preferred, but non-limiting embodiment of the invention will be explained, FIG. 1 showing a schematic view of longitudinal sections through the tool in three typical positions, i.e. a non-activated position with the passage open to fluid, and activated position, with the passage choked before the rotation has been started, and by completed rotation, respectively.

DETAILED DESCRIPTION OF THE PREFERRED EMBODIMENT

Figure 1:
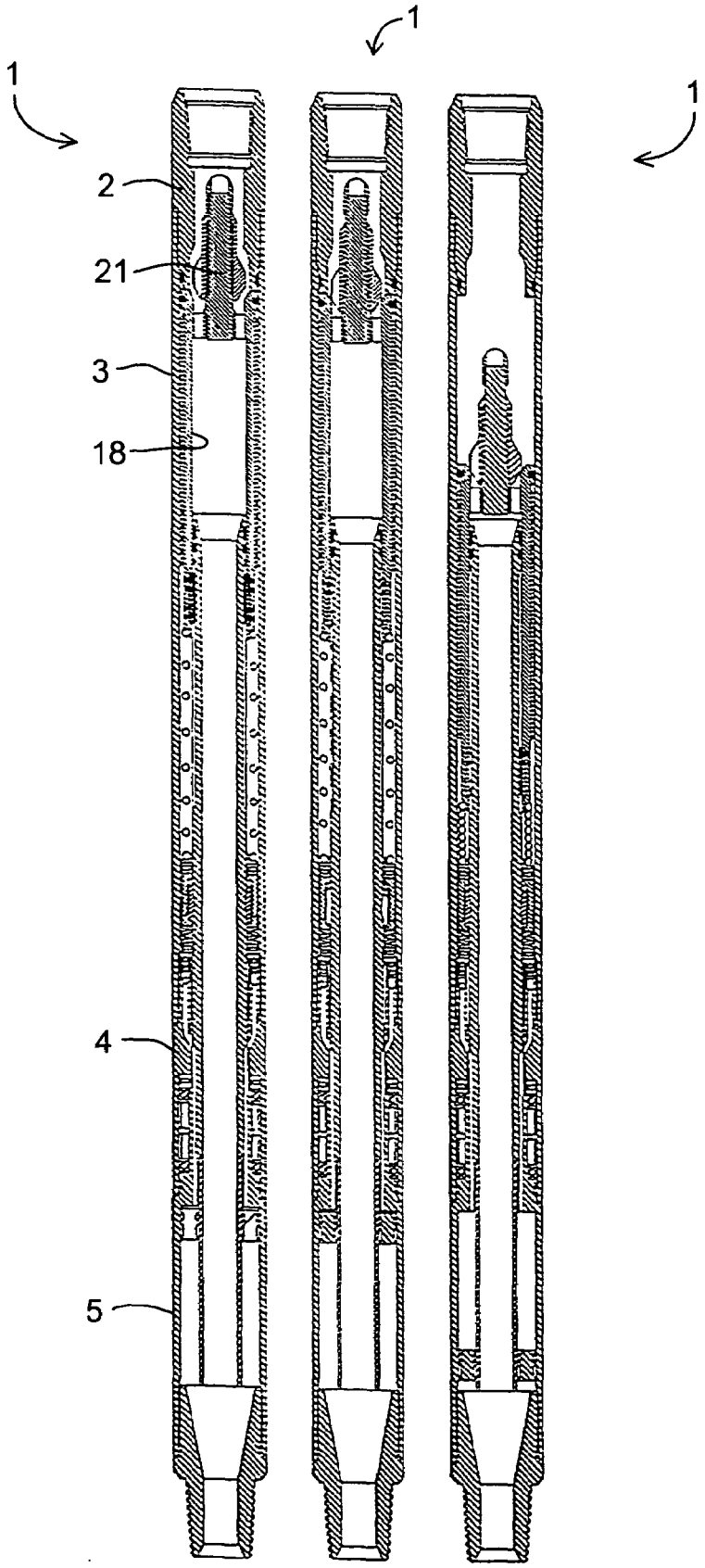
Figure 2:
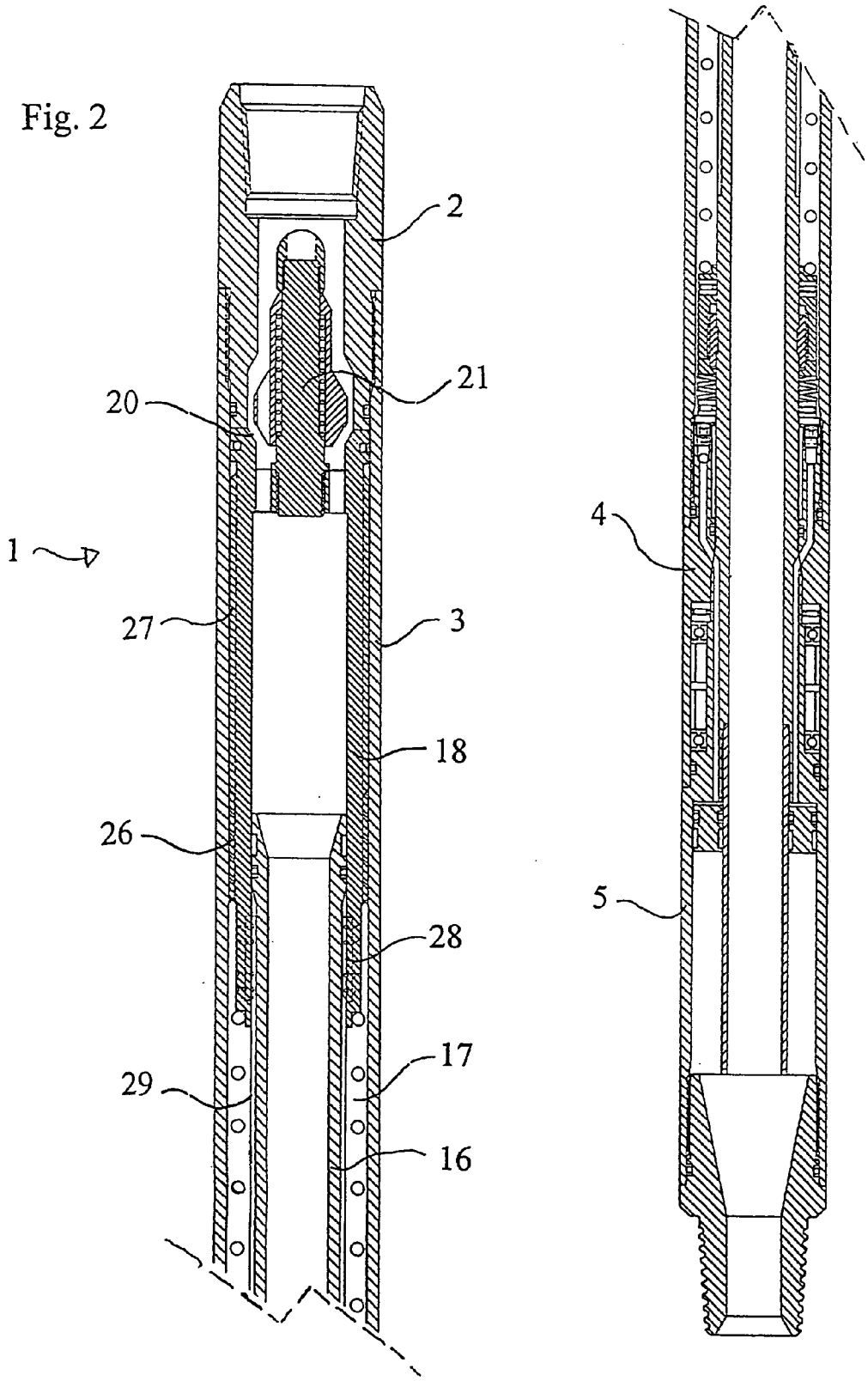
FIG. 2 showing a schematic view of a longitudinal section through a tool in the non-activated position with the passage open to fluid.
Figure 3:
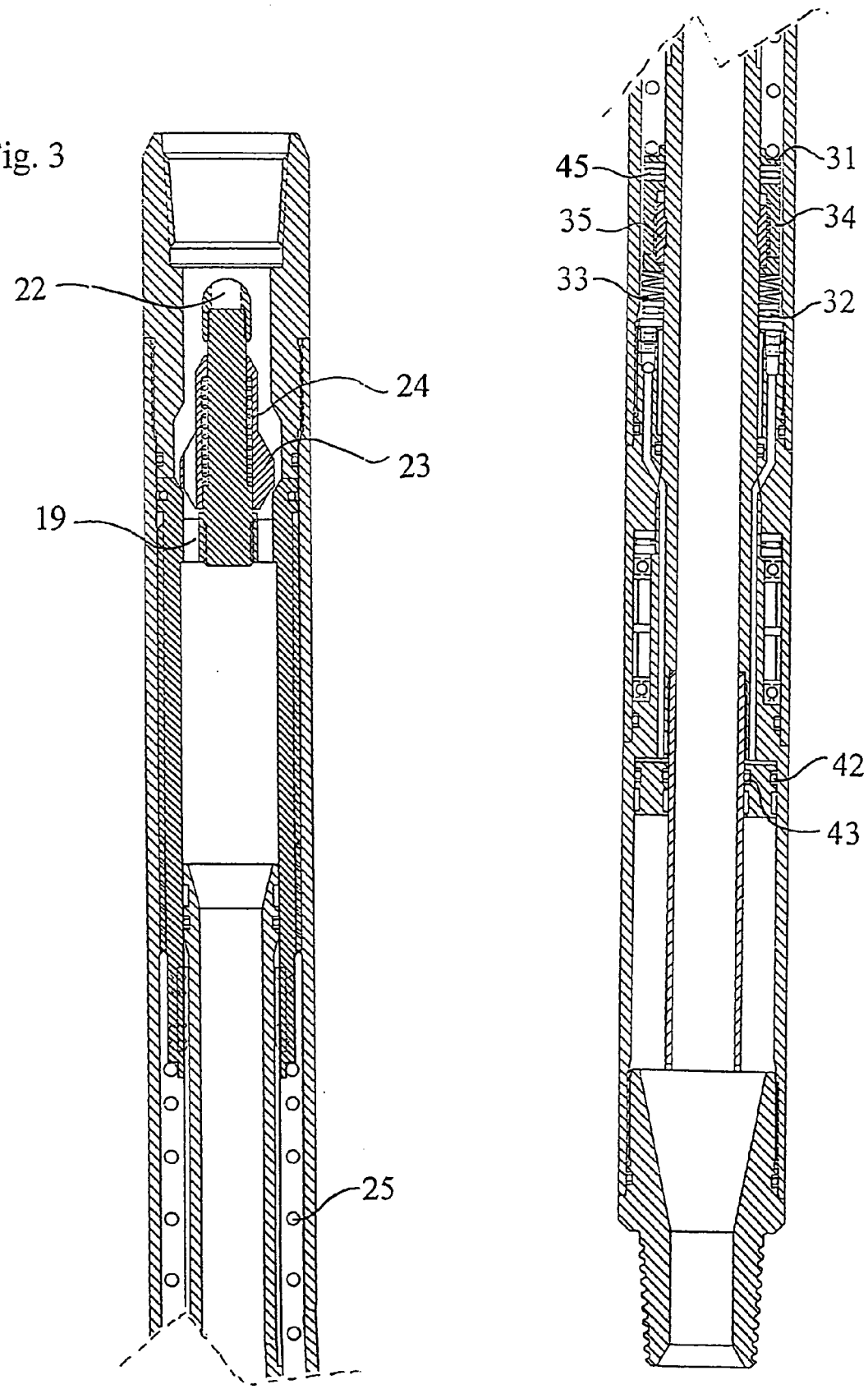
FIG. 3 showing the same schematic view as FIG. 2, but with the tool in the activated position with the passage for fluid choked, so that the tool has been prepared for the rotation.
Figure 4:
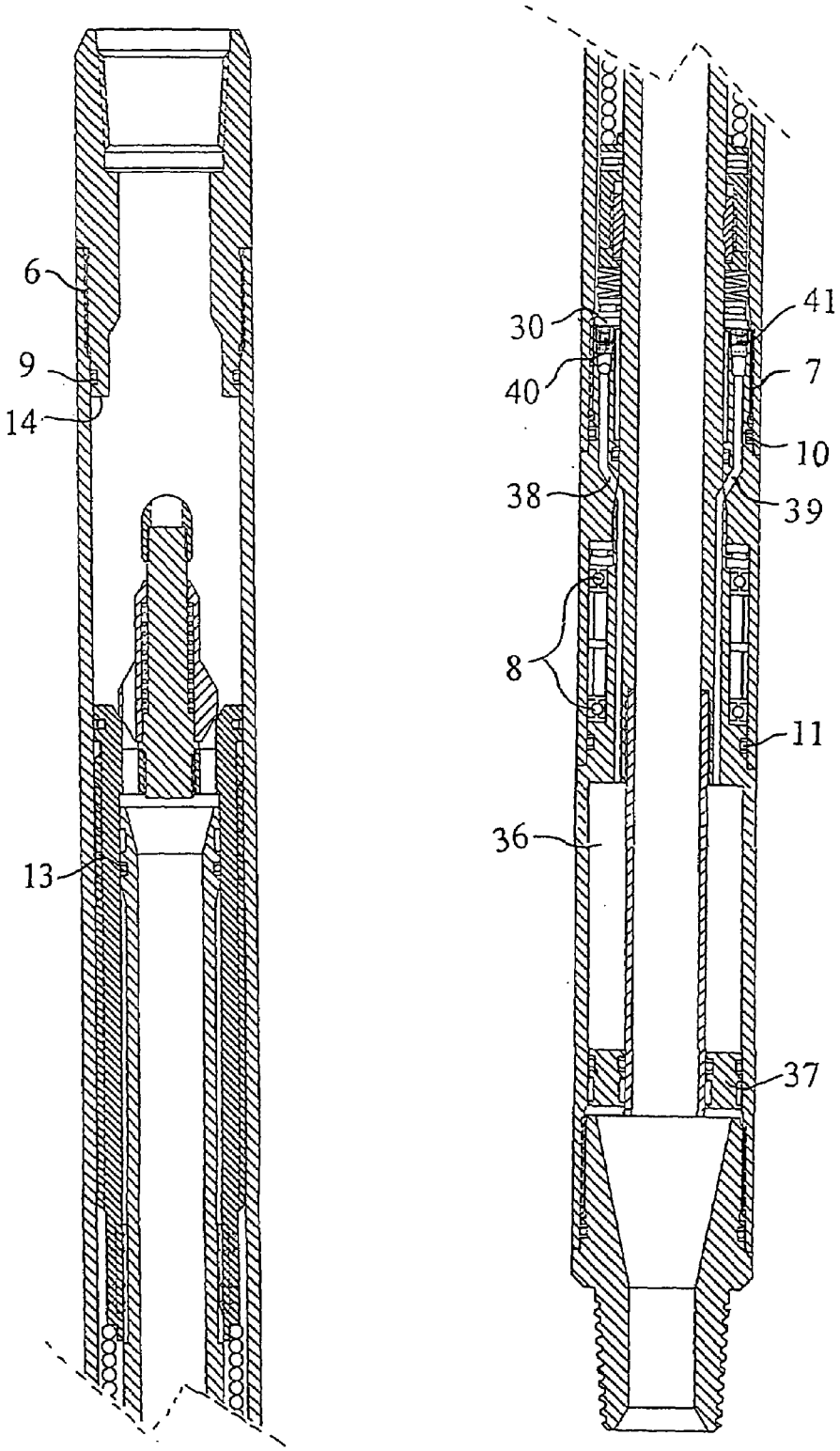
FIG. 4 showing the same schematic view as FIG. 1, but with the activated tool in an end position, by full turn during the rotation.

In FIGS. 2–4 the tool has been divided into two sections for reason of exposition, and the reference numerals have been distributed among the figures, so that the reference numerals of one figure refer to the same details in the other figures.

The tool 1 is made up of housing elements 2, 3, 4, 5 which are connected to one another, and are formed with bores, so that the tool 1 will have a passage for well fluid, among other things. The drill string is fixed to an upper end of the upper housing element 2, and the bent sub is fixed to the lower end of the lower housing element 5. The connections between the housing elements 2, 5, the drill string and the bent sub may, for example, be threaded connections. The upper end of the upper intermediate housing element 3 is fixed to the lower end of the upper housing element 2. The bore of the intermediate housing element 3 has such a fit that the lower end of the upper housing element 2 can be inserted a distance into the intermediate housing element 3. The connection 6 between the housing elements 2, 3 may, for example, be a threaded connection, and it is made pressure-tight by means of a seal 9 provided in the fit between the housing elements 2, 3. The lower end of the upper intermediate housing element 3 is fixed to the upper end of the lower intermediate housing element 4. The bore of the lower end of the upper intermediate housing element 3 has such a fit that the upper end of the lower housing element 5 can be inserted a distance into the upper intermediate housing element 3. The connection 7 between the housing elements 3, 4 may, for example, be a threaded connection, and it is made pressure-tight in that a seal 10 is placed in the fit between the housing elements 3, 4. The lower intermediate housing element 4 is rotationally connected to the lower housing element 5. The connection 8 is such that relative rotation is only allowed in the positive direction, namely the direction of rotation of the bent sub, and may be a roller bearing, for example. It has been made pressure-tight by means of a seal 11 positioned in the fit between the housing elements 4, 5. Moreover, the bore of the lower intermediate housing element 4 is adapted so, that the lower intermediate housing element 4 will be placed externally on, and a distance up from, the lower end of the lower housing element 5. Besides, a thrust bearing is positioned between the upper end of the bearing 8 and an inward shoulder of the intermediate housing element 4.

As mentioned, the lower end of the upper housing element 2 and the upper end of the lower intermediate housing element 4 are inserted into the bore of the upper intermediate housing element 3, and therefore the end surfaces thereof form an upper shoulder 14 in the through passage of the tool 1, and a lower shoulder 30 in an upper annular space 17, respectively. Further, the lower housing element 5 is formed with a length, which makes the lower housing element 5 extend a relatively long distance into the upper intermediate housing element 3. The bore of the upper intermediate housing element 3 moreover has such a wide fit that the upper annular space 17 is formed between the upper intermediate housing element 3 and the part 16 of the lower housing element 5, which extends past the lower shoulder 30.

The tool 1 is provided with a sleeve-shaped piston 18, which is positioned below the upper shoulder 14 of the tool. The piston 18 has a length which allows the piston 18 to extend from the upper shoulder 14, past the upper end of the lower housing element 5 into the upper annular space 17. The fit between the piston 18 and the upper end of the lower housing element 5 is made pressure-tight by means of a seal 13. The piston 18 is formed, correspondingly to the housing elements 2, 3, 4, 5, with a bore, so that the piston 18 does not block the passage of the tool 1. At its upper end, the piston 18 has a valve arranged thereto, with a valve body 21 which may be moved towards a valve seat 20, so that the valve can choke the passage of the tool 1. The valve body 21 is connected to the piston 18 by means of a support element 19 positioned at the upper end of the bore of the piston 18. The support element 19 is formed so that fluid may pass.

The valve is choked as the valve body 21 is about to be seated on the valve seat 20. In the present case the valve is choked by a pressure increase in the fluid passing through the tool. The valve mechanism comprises upper and lower valve body parts 22, 23 which are formed to allow displacement along the valve body 21 in order to choke, or open, the valve. By means of the spring force of a valve body spring 24, the lower valve body part 23 is retained in a first end position, in which the valve is open for fluid to pass. If the pressure in the passing fluid is increased, the fluid will make the lower valve body part 23 be displaced relative to the upper valve body part 22 into a second end position in which the valve is choked, so that there will be a pressure drop in the fluid passing through the valve. When the pressure of the fluid is relieved, the spring force of the valve body spring 24 will open the valve by displacing the lower valve body part 23 relative to the upper valve body part 22 into the first end position. Alternatively, the valve may have a different construction from the one shown in the set of figures, e.g. be formed with a fixed choking. The valve body part 21 and the upper valve body part 22 may have bores, so that a cable placed in the passage may be drawn through the valve.

As a consequence of the pressure drop across the valve, the fluid which is supplied to the tool 1 when the valve has been choked, will cause the piston 18 to be driven from a first end position, in which the upper end of the piston 18 rests on the upper shoulder 14, into a second end position, in which the lower end of the piston 18 has compressed a piston spring 25 positioned in the upper annular space 17. The spring force of the compressed piston spring 25 will cause the piston 18 to be driven back into abutment on the upper shoulder 14 when the valve is reopened by reduction of the fluid pressure. At its lower end, the piston spring 25 rests on a shoulder element 31 located in the upper annular space 17 above the lower shoulder 30. Between the shoulder 30 and the shoulder element 31 is placed a lower thrust bearing 32, disc springs 33, a support element 34 which is retained in position by a locking mechanism 35, and an upper thrust bearing 45. The locking mechanism 35 is somewhat recessed in the side wall of the part 16 of the lower housing element 5 facing inwards towards the upper annular space 17.

Fluid will be displaced from the upper annular space 17 during rotation. When being displaced, this fluid is led to a lower annular space 36, which is formed in the passage of the tool at the lower end of the lower housing element 5. The lower annular space 36 is sealed by means of a displaceable annular space body 37, which has been made pressure-tight by means of seals 42, 43. The annular space body 37 is displaced down the lower annular space 36 by fluid which is displaced from the upper annular space 17, and it is displaced up the lower annular space 36 by the fluid in the passage after the valve has opened. Alternatively the upward displacement may take place by means of a spring not shown, which is placed in the lower annular space 36 below the annular space body 37. Channels 38, 39 provide passage from the upper annular space 17 to the lower annular space 36. One of the channels 38 is sealed towards the upper annular space 17 by means of a check valve 40, and the other one of the channels 39 is sealed towards the upper annular space 17 by means of a choke valve 41. Said valves 40, 41 are placed in the lower shoulder 30. Additionally, the thrust bearings 32, 45, the spring discs 33 and the support section 34 are arranged so, that the fluid which is displaced during rotation, may pass.

Figure 5:
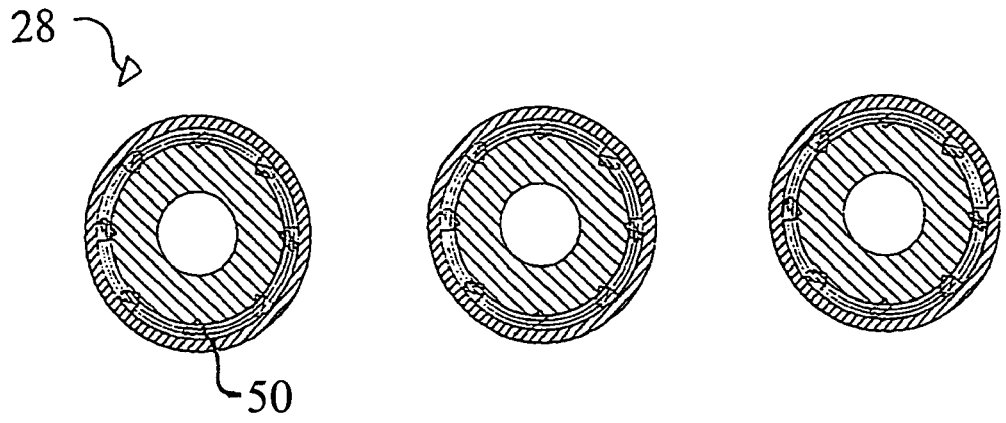
FIG. 5 showing a schematic view of a section in the transversal direction through the ratchet mechanism when the tool is in the positions mentioned above.
Figure 6:
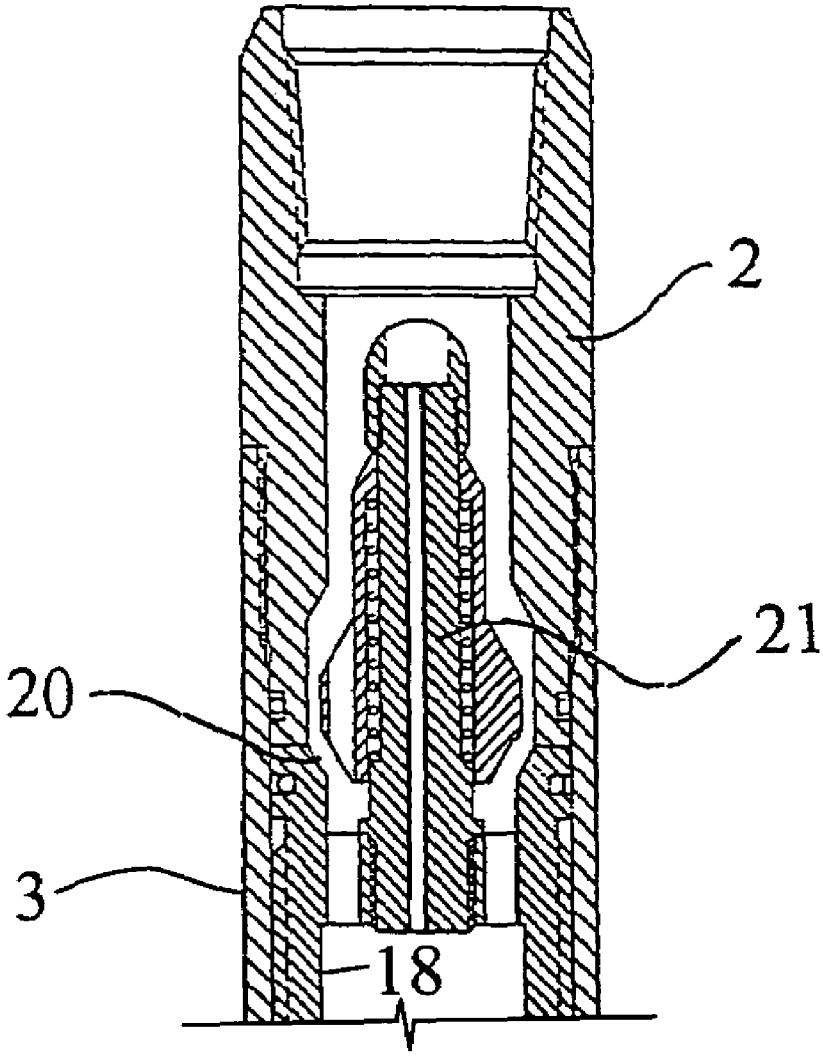
FIG. 6 showing a schematic view of a longitudinal section through part of the tool with an alternative valve body.

To provide forced rotation of the lower housing element 5, which is connected to the bent sub, concurrently with the piston 18 being displaced in the passage of the tool 1, a circumferential portion of the bore of the upper intermediate housing element 3, preferably in the region at the upper end of the lower housing element 5, and a circumferential portion of the piston 18, preferably along the major part of the length of the piston 18, are formed with guides 26, 27 such as twisted splines. Further, the piston 18 is rotationally connected to the upper end of the lower housing element 5. This rotational connection may be formed by a ratchet mechanism 28, arranged so that it can be displaced along a number of guides 29. The guides 29 are positioned at the upper end and on that side of the lower housing element 5, which faces the upper annular space 17. Moreover, the guides 29 preferably extend along large parts of the wall in, and preferably parallel to, the longitudinal direction of the upper annular space 17. The catch elements 50 (see FIG. 5) of the ratchet mechanism will bear in a locking manner against the guides 29, so that rotation of the lower housing element 5 in the positive direction is forced during the downward rotation of the piston, but rotation of the piston 18 relative to the lower housing element 5 is allowed in the opposite direction when the piston 18 returns.

The present invention will allow the rotation of the bent sub to be infinitely variable. Through reduction of the fluid pressure, so that the valve of the piston 18 opens the fluid passage, the rotation may moreover be interrupted when the desired turn has been reached. By greater turns, the rotation takes place in that the valve of the tool 1 is choked, opened, choked etc. until the bent sub is in the desired position. The ratchet mechanism 28 connecting the piston 18 and the lower housing element 5, will help to allow the drill bit to be driven during full admission. When the piston spring 25 carries the piston 18 back into its initial position in abutment on the upper shoulder 14 after the opening of the valve, the ratchet mechanism 28 and the rotational connection 8 will allow for the piston 18 to rotate in the opposite direction. At the same time the lower housing element 5 remains stationary without rotation. It should be mentioned that the ratchet mechanism 28 and the rotational connection 8 may be replaced by connections which are locked mechanically.

The description will be concluded by a brief review of the operation of the present tool. As mentioned, FIG. 2 shows the tool 1 in a non-activated position during the drilling. The valve is then open, so that fluid circulating in the drill string can pass unobstructedly through the tool 1. The tool 1 is activated for rotation by increasing the pressure of the fluid passing through the tool 1. The increased fluid pressure displaces the lower valve body part 23 down along the valve body 21, so that the lower valve body part 23 is carried into a position in abutment on the valve seat 20. Thereby the valve is choked. Due to the pressure drop across the choked valve, the fluid, which is supplied to and passes through the tool 1 after the valve has been choked, will displace the piston 18 down the passage of the tool 1. Thereby the guides 26, 27 will force a rotation on the piston 18, guided by the curvature of the guides 26, 27. During the displacement of the piston 18 down the tool 1, the catch elements 50 of the ratchet mechanism 28 abut, and are at the same time moved down along the guides 29 of the upper part of the lower housing element 5, so that the lower housing element 5 fitted with a bent sub rotates to provide a change of the direction of drilling. The speed of rotation may, as earlier mentioned, be controlled by means of the choking of the choke valve 41 of the channel 39 between the annular spaces 17, 36.

The rotation ends by relief of the pressure of the fluid. Consequently, the spring force of the valve body spring 24 will exceed the fluid pressure and displace the lower valve body part 23 up along the valve body 21, so that the valve opens. When the valve is open, the spring force of the compressed piston spring 25 in the annular space 17 will displace the piston 18 up the passage of the tool 1. During the return movement of the piston 18, the catch elements 50 of the ratchet mechanism 28 will allow rotation of the piston 18, whereas the lower housing element 5 remains in a position, in which the housing element 5 does not rotate. Similarly, the rotational connection 8 between the housing elements 4, 5 will contribute to the same, if the ratchet mechanism cannot fully manage to take care of the rotation returning the piston 18. By major changes of direction the above-mentioned cycle is repeated until the desired turning of the bent sub has been reached.

While the foregoing is directed to embodiments of the present invention, other and further embodiments of the invention may be devised without departing from the basic scope thereof, and the scope thereof is determined by the claims that follow.

What is claimed is:

1. A tool for changing the direction of drilling with drilling equipment, comprising:

at least two housing elements rotationally connected to one another in one direction, wherein a first housing element has a first guide;

a first passage for fluid through the tool; and a hydraulic piston rotationally connected to a second housing element and having a second guide, wherein:

the guides and the piston-second housing connection are arranged, by the piston's axis displacement, to rotate the second housing element with respect the first housing element, necessary fluid pressure for moving the piston is obtained by choking the fluid flow though the tool, and the tool is configured to change the direction of drilling in a substantially infinitely variable manner in response to a change in flow rate of a drilling fluid.

2. The tool of claim 1, wherein the first guide is formed in an inner wall of the first housing element, and the second guide is formed in an outer wall of the piston.

3. The tool of claim 2, wherein the guides comprise twisted splines.

4. The tool of claim 3, wherein the first spline extends along a substantial length of the first housing element and the second spline extends along a substantial length of the piston.

5. The tool of claim 1, further comprising a valve comprising a valve seat formed at the upper end of a bore adapted to provide a passage through the piston, a valve body and a valve mechanism adapted for choking and opening the valve by increase and relief, respectively, of the fluid pressure in the tool.

6. The tool of claim 5, wherein the piston is adapted to be displaced by the fluid supplied to the tool when the valve has been choked, or be displaced in the opposite direction by a piston spring, positioned in an upper annular space, formed in the passage of the tool, after the valve has opened.

7. The tool of claim 6, wherein the piston is sleeve-shaped, positioned between an upper shoulder formed in the passage of the tool, and a shoulder element located in the upper annular space and formed with a length which enables the piston to extend from the upper shoulder into the upper annular space located in an extension above a lower shoulder formed at the lower end of the upper annular space.

8. The tool of claim 6, wherein the second housing element comprises a first and a second annular space arranged therein, for fluid which is displaced from the first annular space; the annular spaces communicate by channels extending between the annular spaces respectively; and the flow of displaced fluid can be controlled by a check valve and a choke valve placed in the respective channels.

9. The tool of claim 8, wherein a displaceable annular space body is disposed in the second annular space.

10. The tool of claim 5, wherein the valve mechanism is formed by a valve body part adapted for displacement along the valve body, so that the valve body part can choke or open the valve, and a valve body spring, wherein the valve body part will displace along the valve body when a flow rate of the fluid is increased, and the valve body part spring will displace the valve body part in the opposite direction to open the valve when the flow rate of fluid is decreased.

11. The tool of claim 10, wherein the valve body is formed with a bore, so the that a cable can be drawn through the passage of the tool.

12. The tool of claim 1, wherein the piston and the second housing element are rotationally connected in one direction.

13. The tool of claim 12, wherein the connection between the piston and the second housing element is formed by a ratchet mechanism comprising catch elements locking against, or running freely across, a third guide formed at the upper end of th second housing element, so that the second housing element is subjected to rotation when the piston is displaced down the tool, but not subject to rotation when the piston is displaced back up the tool.

14. The tool of claim 1, wherein the one direction rotational connection between the housing elements comprises a roller bearing adapted for rotation in one direction and opposing rotation in the opposite direction in any rotational position.

15. The tool of claim 1, further comprising a second passage for fluid defined by an inner wall of the first housing element and an outer wall of the second housing element, wherein a choke valve is disposed within the second passage for controlling the peed of rotation of the tool.

16. A tool adapted for changing the direction of drilling with drilling equipment comprising a drill string, drill string sub, drilling engine and drill bit, wherein the tool is positioned between the drill string and the drill string sub and wherein the tool comprises:

housing elements, which are connected to one another, and wherein the tool has a passage for fluid and wherein the tool is equipped with a hydraulic piston having a set of cooperating guides where the guides are arranged for, by the pistons axial displacement, a forced guiding of the rotation of a first housing element with respect to the other housing elements, and where necessary fluid pressure for moving the piston is obtained by choking the fluid flow through the tool and wherein a lower intermediate housing element and a lower housing element are connected by a one direction rotatable connection; and a valve comprising:

a valve seat formed at the upper end of a bore adapted to provide a passage through the piston;

a valve body; and a valve mechanism adapted for choking and opening the valve by increase and relief, respectively, of the fluid pressure in the tool, wherein the valve mechanism is formed by an upper and a lower valve body part adapted for displacement along the valve body, so that the lower valve body part can choke or open the valve, and a valve body spring, wherein the upper valve body part will displace the lower valve body part to choke the valve when the pressure of the fluid is increased, and the valve body part spring will displace the lower valve body part in the opposite direction to open the valve by relief of the pressure of the fluid.

17. The tool of claim 16, wherein the valve body and the upper valve body part are formed with bores, so that a cable can be drawn through the passage of the tool.

18. A tool adapted for changing the direction of drilling with drilling equipment comprising a drill string, drill string sub, drilling engine and drill bit, wherein the tool is positioned between the drill string and the drill string sub and wherein the tool comprises:

housing elements, which are connected to one another, and wherein the tool has a passage for fluid, and wherein the tool is equipped with a hydraulic piston having a set of cooperating guides where the guides are arranged for, by the pistons axial displacement, a forced guiding of the rotation of a first housing element with respect to the other housing elements, and where necessary fluid pressure for moving the piston is obtained by choking the fluid flow through the tool and wherein a lower intermediate housing element and a lower housing element are connected by a one direction rotatable connection, and wherein the piston is adapted to be displaced by the fluid supplied to the tool when the valve has been choked, or be displaced in the opposite direction by a piston spring, positioned in an upper annular space, formed in the passage of the too after the valve has opened, and wherein the lower housing element has a lower annular space arranged thereto, for fluid which is displaced from the upper annular space, and wherein the annular spaces communicate by means of channels extending between the annular spaces respectively, and wherein the flow of displaced fluid can be controlled by a check valve and a choke valve placed in the respective channels;

a valve comprising:

a valve seat formed at the upper end of a bore adapted to provide a passage through the piston, a valve body, and a valve mechanism adapted for choking and opening the valve by increase and relief, respectively, of the fluid pressure in the tool.

19. The tool of claim 18, wherein the lower annular space has a displaceable annular space body arranged therein.

20. A tool for changing the direction of drilling with drilling equipment, comprising:

a first housing; and a piston configured to rotate relative to the first housing when actuated by a fluid pressure;

wherein the tool is configured to change the direction of drilling in a substantially infinitely variable manner in response to a sustained change in flow rate of drilling fluid and the rotation of the piston.

21. The tool of claim 20, further comprising:

a valve configured to choke the flow of the drilling fluid through the tool, thereby providing the fluid pressure to actuate the piston.

22. The tool of claim 20, wherein the first housing comprises a first guide, the piston comprises a second guide, and interaction of the guides causes the piston to rotate relative to the first housing upon actuation of the piston.

23. The tool of claim 20, further comprising a second housing rotationally connected to the piston in a first direction and rotationally connected to the first housing in a second direction which is opposite to the first direction.

24. The tool of claim 20, wherein the tool is configured to change the direction of drilling while drilling.

25. The tool of claim 20, wherein the drilling equipment comprises a drill tit, and the tool is configured to change the direction of drilling without substantially reducing admission of the drill bit.

26. The tool of claim 20, wherein the drilling equipment comprises a bent sub and the tool is configured to change the direction of drilling by being configured to rotate the bent sub.

* * * * *

UNITED STATES PATENT AND TRADEMARK OFFICE

CERTIFICATE OF CORRECTION

PATENT NO. : 6,955,231 B1
APPLICATION NO. : 10/030413
DATED : October 18, 2005
INVENTOR(S) : Stig Bakke It is certified that error appears in the above-identified patent and that said Letters Patent is hereby corrected as shown below:

In column 6, line 67, after the phrase "upper end of", please delete "th" and insert --the--.

In column 8, line 53, please delete "tit" and insert --bit--.

Signed and Sealed this

Twenty-sixth Day of September, 2006

JON W. DUDAS
*Director of the United States Patent and Trademark Office*